United States Patent [19]

Alcamo

[11] 4,130,908

[45] Dec. 26, 1978

[54] HANDSCRUBBING DEVICE

[76] Inventor: John H. Alcamo, 5 Canfield St., Budd Lake, N.J. 07828

[21] Appl. No.: 874,659

[22] Filed: Feb. 2, 1978

[51] Int. Cl.[2] ..... A47K 7/04

[52] U.S. Cl. ..... 15/21 R

[58] Field of Search ..... 15/21 R, 21 B, 21 C, 15/21 D, 97 R; 134/6; 4/184, 166

[56] References Cited

U.S. PATENT DOCUMENTS

| | | | |
|---|---|---|---|
| 1,366,306 | 1/1921 | Nick | 15/21 C |
| 2,952,859 | 9/1960 | Alcamo | 15/21 D |
| 3,439,370 | 4/1969 | McLaughlin | 15/21 R |
| 3,918,117 | 11/1975 | Plante | 15/21 D |

*Primary Examiner*—Edward L. Roberts

*Attorney, Agent, or Firm*—Roger A. Clapp

[57] ABSTRACT

Apparatus for automatically scrubbing a user's hand and fingers is disclosed in which three brush assemblies cooperate to perform the cleaning function. The first brush assembly includes a rotatable knob having outwardly projecting exterior bristles, the second includes a rotatable hollow cylinder annularly surrounding the knob and including inwardly projecting interior bristles, and the third bush assembly includes three individual rotatable finger brushes disposed between the knob and the cylinder in which each brush is hollow, has inwardly directed interior bristles and outwardly directed exterior bristles.

7 Claims, 3 Drawing Figures

HANDSCRUBBING DEVICE

BACKGROUND OF THE INVENTION

1. Field of the Invention

This invention relates to handcleaning apparatus and pertains to devices in which a user's hand and fingers are inserted into the device for cleaning by rotating bristles.

2. Description of the Prior Art

Automatic handcleaning devices have particular application in the medical field; i.e., for medical personnel preparing for a surgical procedure. Such devices are well known and examples are illustrated in U.S. Pat. Nos. 2,952,859 and 2,961,672 issued on Sept. 20, 1960 and Nov. 29, 1960 respectively, to John H. Alcamo.

Generally, the prior art devices have worked well for many applications. Microscopic tests, however, have revealed that lodged bacteria is not adequately removed from all of the hand surfaces as, for example, between the base of the fingers (the "webbed concavity") and the inner sides of each finger.

Accordingly, it is broadly the object of this invention to increase the amount of lodged bacteria removed from the hand and fingers during the scrubbing operation.

Another object of this invention is to obtain more thorough cleaning in a convenient and inexpensive manner.

SUMMARY OF THE INVENTION

In accordance with a preferred embodiment of the invention, a brush assembly containing three individual finger brushes cooperates with outer and inner brush assemblies to increase the amount of lodged bacteria removed during the hand scrubbing operation.

In accordance with one feature of this invention, the outer brush assembly comprises a hollow cylinder having inwardly directed interior bristles adapted to remove lodged bacteria from the posterior surface of the hand and fingers of a user when the cylinder is rotated.

In accordance with another feature of this invention, the inner brush assembly comprises a knoblike member having outwardly directed exterior bristles adapted to remove lodged bacteria from the interior or palmar surface of the hand and fingers of a user when the member rotates.

In accordance with another feature of this invention, each finger brush is hollowed to accommodate an inserted finger and has inwardly directed interior bristles to remove lodged bacteria from the surface of the inserted finger and outwardly directed exterior bristles to remove lodged bacteria from the webbed concavity between fingers and sides of adjacent non-inserted fingers when the finger brush is rotated.

A better understanding of these and other objects and features of this invention will be facilitated by reference to the following detailed description and drawing in which:

DETAILED DESCRIPTION OF THE INVENTION

Figure 1:
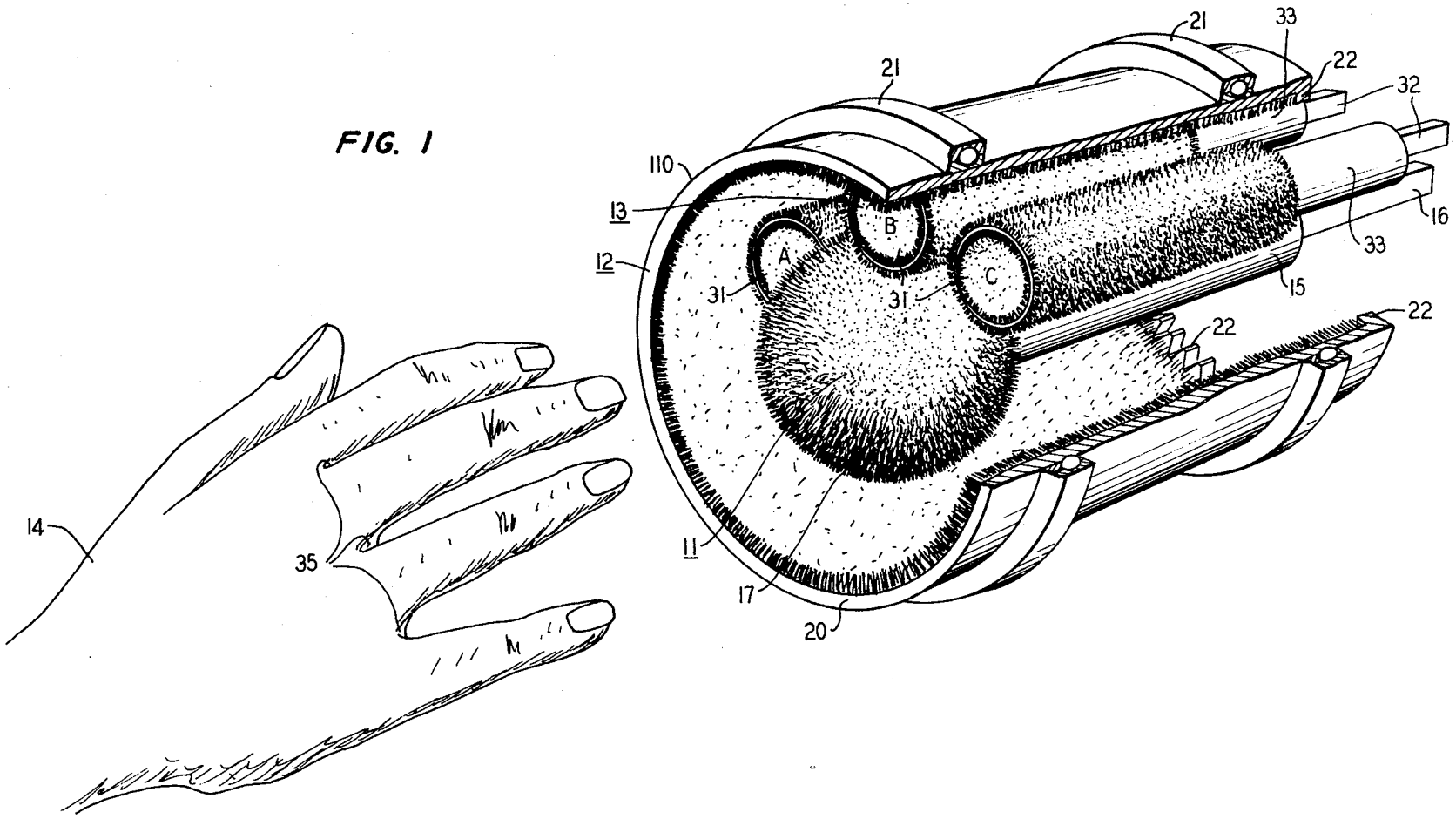
FIG. 1 is a perspective view with portions broken away showing three brush assemblies combined in accordance with this invention and illustrating a user's hand and fingers about to be inserted therein.
Figure 2:
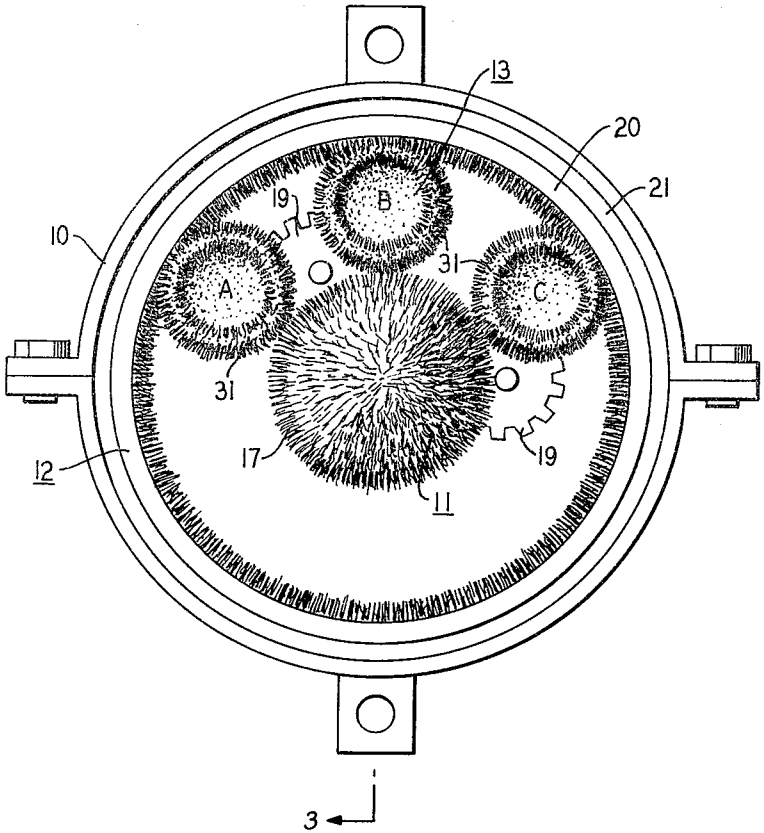
FIG. 2 is an end elevation view of the brush assembly combination shown in FIG. 1.

Referring to FIGS. 1 and 2, a scrubbing mechanism for cleaning the inserted hand and fingers of a user is illustrated comprising three brush assemblies 11, 12, and 13 which are combined in a housing 10. A hand 14 is shown in exemplary form in FIG. 1 and, as will be explained more completely later on, the three brush assemblies are adapted to simultaneously and cooperatively rotate to achieve thorough scrubbing of the surfaces of the hand 14 when it is inserted therein.

Figure 3:
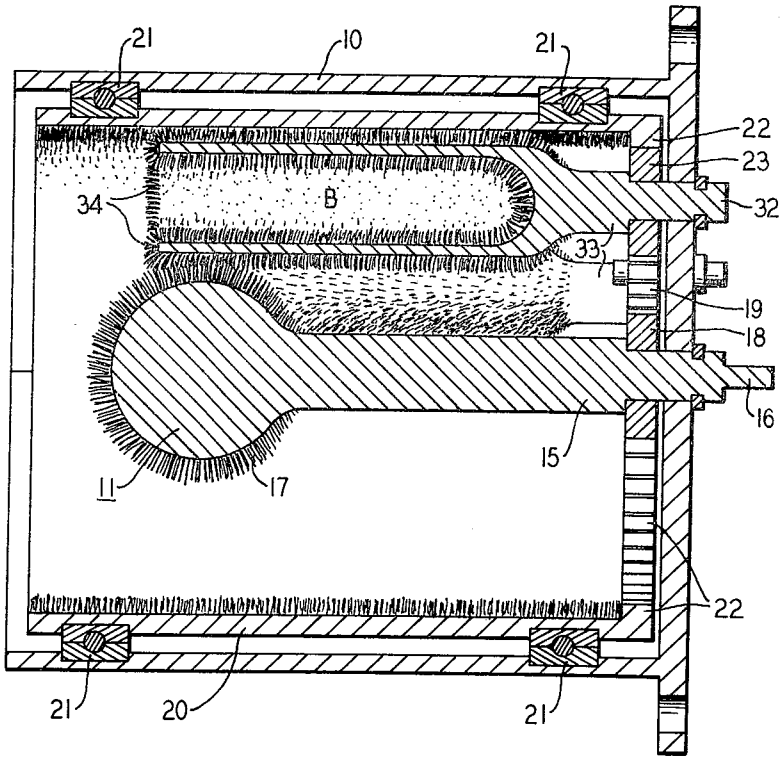
FIG. 3 is a side elevation view of the brush assembly combination shown in FIG. 2 taken in section along the line 3—3.

As best illustrated in FIGS. 1 and 3, the brush assembly 11 comprises a stem 15, drive key 16 and knob 17. All are advantageously joined in a unitary structure made of a strong material such as steel. The know 17 is ball-shaped to fit a user's palm and is covered with a plurality of outwardly projecting exterior bristles. The drive key 16 is adapted to engage a power source (not shown) and a driving gear 18 mounted on the housing 10. As best seen in FIG. 3, the driving gear 18 engages one of several idler gears 19 mounted on the housing 10.

The brush assembly 12 annularly surrounds the stem 15 and knob 17 structure and comprises a cylinder 20 surmounted by two mounting members 21. The cylinder 20 is hollowed to accommodate insertion of the hand 14 and is advantageously made up of a strong material such as steel. The inside is covered with a plurality of projecting inwardly directed interior bristles adapted to scrub the posterior surfaces of an inserted hand and fingers. In addition, one end may advantageously include a ring gear 22 which, as best seen in FIG. 3, is engaged and driven by one of several drive gears 23. Advantageously the mounting mechanism 21 comprises bearing assemblies rotatably linking the cylinder 20 to the housing 10.

The brush assembly 13 comprises three finger brushes 30 and, as best seen in FIGS. 1 and 3, each finger brush 30 includes an end 31 hollowed out as at A, B, and C. Moreover, each finger brush 30 includes a drive key 32 and a linking stem 33. Advantageously, the parts are formed as a unitary structure made of a strong material such as steel. Alternatively, however, the ends 31 can be flexible to facilitate conforming of the fingers to the brush assemblies. Each hollow end 31 is coated with a continuous cover of projecting interior and exterior bristles which form an exterior bristled lip 34 for scrubbing the webbed concavities 35 on the hand 14 of the user. As best seen in FIGS. 1 and 2, the finger brushes 30 are disposed between the cylinder 20 and the knob 17 and as shown in FIG. 3, each is rotatably attached to a gear 23 by it's drive key 32. As shown in FIGS. 2 and 3, the drive gears 23 and the drive gear 18 are linked by the idler gears 19.

The specific spacing of the finger brushes 30, as best seen from FIGS. 1 and 2, is set so that the opening A will accommodate a user's thumb, the opening B will accommodate a user's middle finger and the opening C will accommodate a user's small finger. The finger brushes 30 are spaced from each other so that the openings between adjacent brushes are adapted to accommodate the index and ring fingers of a user's hand, respectively.

In operation, a user inserts his hand and fingers into the housing 10. When inserted, the palmar or anterior portion of the hand, index and ring fingers engage the bristles on the know 17, while the back or posterior portion of the hand, index and ring fingers engage the bristles projecting from the cylinder 20. The thumb, middle and small fingers, however, are each embraced by the bristles within an individual brush 30. Finally, exterior bristles on the brushes 30 engage the sides of the index and ring fingers, the bristles within the hollow of the ends 31 engage the tip and nails of the inserted fingers and the bristles at the lips 34 engage the webbed concavities between the fingers. Consequently, when the knob 17, cylinder 20 and brushes 30 rotate, all of the inserted hand and finger surfaces will be scrubbed.

As seen from FIGS. 2 and 3, rotation of all brush units is responsive to rotation of the drive key 16. As the drive key 16 rotates, it rotates in turn the drive gear 18. The drive gear 18 then rotates the idler gears 19 which, in turn, rotate the drive gears 23 and their associated stems 33. Finally as the drive gears 23 rotate, one or more engage the ring gear 22 on the cylinder 20. As a result, the entire assembly commences rotation when the drive key 16 is rotated.

In summary, a combination of brush assemblies has been disclosed which cooperate to achieve full engagement with the hand and finger surfaces of a user so as to obtain extensive removal of lodged bacteria during a scrubbing operation. Moreover, that result is achieved in an inexpensive and convenient device. While only one embodiment of the invention has been disclosed, it is representative of the principles of the invention and it will be recognized that many other embodiments falling within the scope of the invention will readily occur to those skilled in the art.

What I claim is:

1. In apparatus for mechanically scrubbing the hand and fingers of a user, the combination comprising:

first brush means for engaging inserted palm and selected finger portions of a user's hand and scrubbing the surfaces thereof when rotated;

second brush means for engaging the inserted back and selected finger portions of a user's hand and scrubbing the surfaces thereof when rotated, said second brush means being annularly disposed with respect to said first brush means;

third brush means for internally accommodating selected inserted fingers of a user, externally engaging selected inserted palm and finger portions of a user and scrubbing said inserted fingers and palm and finger portions when rotated, said third brush means being disposed between said first and second brush means; and means for rotating said first, second and third brush means so as to simultaneously scrub all of the exterior surfaces of a user's inserted hand and fingers.

2. The combination in accordance with claim 1 wherein said first brush means includes a knob covered with outwardly projecting exterior bristles.

3. The combination in accordance with claim 1 wherein said second brush means includes a hollow cylinder equipped with inwardly projecting interior bristles and having an opening wide enough to accommodate a user's hand when inserted therein.

4. The combination in accordance with claim 1 wherein said third brush means includes three hollow members wherein each is adapted to accommodate a finger inserted into the hollow thereof, each is equipped with interior bristles projecting into said hollow and adapted to engage the surface of an inserted finger, and each is equipped with exterior bristles projecting outwardly to engage selected portions of a user's inserted hand and fingers.

5. The combination in accordance with claim 1 wherein said first brush means includes a knob equipped with outwardly projecting exterior bristles, said second brush means includes a hollow cylinder equipped with inwardly projecting interior bristles and open wide enough to accommodate a hand inserted therein by a user, and said third brush assembly includes three individual hollow members wherein each of said members accommodates a finger inserted in the hollow thereof, each is equipped with interior bristles projecting into said hollow to engage the surface of an inserted finger, and each is equipped with exterior bristles projecting outwardly to engage selected portions of a user's inserted hand and fingers.

6. The combination in accordance with claim 5 wherein said knob and said hollow members are mounted at the end of rotatable stems.

7. The combination in accordance with claim 5 wherein the bristles on each member cover the interior and exterior surfaces of each member so that the lip of each is tufted to engage the webbed concavities on an inserted hand.

* * * * *